US006808108B1

(12) United States Patent
Turnbow et al.

(10) Patent No.: US 6,808,108 B1
(45) Date of Patent: Oct. 26, 2004

(54) MAILBOX SECURITY DEVICE

(76) Inventors: Steven A. Turnbow, 2800 Park Dr., Arlington, TX (US) 76016; Kristy M. Turnbow, 2800 Park Dr., Arlington, TX (US) 76016

( * ) Notice: Subject to any disclaimer, the term of this patent is extended or adjusted under 35 U.S.C. 154(b) by 0 days.

(21) Appl. No.: 10/303,356

(22) Filed: Nov. 22, 2002

(51) Int. Cl.[7] ..... B65D 91/00
(52) U.S. Cl. ..... 232/29; 232/17; 232/33
(58) Field of Search ..... 232/17, 29, 33, 232/30–32; 220/23.87, 23.89

(56) References Cited

U.S. PATENT DOCUMENTS 4,333,603 A * 6/1982 Carlson ..... 232/17
4,361,271 A * 11/1982 Hester et al. ..... 232/17
4,726,512 A * 2/1988 White ..... 232/17
4,848,650 A * 7/1989 Roberts, II ..... 232/17
5,915,618 A * 6/1999 Gaudet ..... 232/33

* cited by examiner

*Primary Examiner*—William L. Miller
(74) *Attorney, Agent, or Firm*—Melvin A. Hunn

(57) ABSTRACT

An improved mailbox is provided which includes a security subassembly. The security subassembly includes an elongated sleeve which is fixed into position relative to a mailbox. It further includes a security door which is locked into position relative to the elongated sleeve. A mail slot is provided in the security door which allows for a mail carrier to deposit mail within the central cavity of the mailbox. A locking mechanism is provided to allow the security door to be moved between a normally closed condition and an open condition to allow the authorized user to remove mail from the central cavity of the mailbox.

2 Claims, 3 Drawing Sheets

MAILBOX SECURITY DEVICE

BACKGROUND OF THE INVENTION

1. Field of the Invention

The present invention relates in general to mail box systems, and in particular to security systems for use in mailboxes to secure mail items.

2. Description of the Prior Art

The United States is currently experiencing a rapid increase in identity theft crimes. A thief will obtain information about an individual and misuse that information in order to create or draw down on lines of credit, and/or to submit fraudulent loan and credit applications. Typically, the thief must obtain a fairly large amount of specific and accurate information about an individual before the identity can be misappropriated. The most common source of the information is through stolen mail. A thief will select a target and then systematically steal items of mail from the target's mail box. The thief will then utilize that information in order to draw down on bank accounts or credit cards. Alternatively, the thief may utilize the identity information in order to complete applications for new loans or credit cards. Sometimes, thieves are stealing outgoing mail in order to obtain checking account information from bills that are being paid by the target. The thief may then fabricate fraudulent checks which appear to be drawn on the target's account. The thief may then cash or deposit the checks into other accounts thus depleting the target's checking account of funds.

One reason that identity theft is increasing is that most mailbox devices have little or no security to prevent thieves from stealing incoming mail or outgoing mail.

SUMMARY OF THE INVENTION

It is one objective of the present invention to provide an improved mailbox which includes a security system which prevents or deters thieves from easily taking incoming or outgoing mail from the mailbox.

It is another objective of the present invention to provide a system which may be retrofit into existing mailboxes which provides security for the existing mailboxes without requiring replacement of those boxes.

These and other objectives are achieved as is now described. An improved mailbox is provided. It includes a main housing which has a central cavity for receiving and storing mail items. A main door is provided for the main housing. It is secured to the main housing. It encloses the main housing and thus protects mail items maintained within the main housing from ambient conditions. The ambient conditions may include high winds, high temperatures, rain, snow, sleet, and high humidity. These ambient conditions could injure mail items if they are not properly housed. A hinge is provided for coupling the main door to the main housing. This allows the main door to move freely between an open condition and a closed condition. In accordance with the preferred embodiment of the present invention, a security subassembly is also provided. It is located at least in part within the main housing. It is secured in a fixed position thereto. In one embodiment, it may be affixed by fasteners to the main housing of the improved mailbox. In alternative embodiments, it may be secured through glue or adhesives (such as Liquid Nail brand glue) to the main housing of the improved mailbox. Alternative fasteners may be employed to secure the security subassembly to the main housing of the improved mailbox. A security door is provided. It is coupled to the security subassembly. Additionally, a lock mechanism is provided. It is operatively associated with the security door and adapted to secure the security door in a normally-closed condition. However, it permits an authorized user, having a key to remove mail items from the main housing by moving the security door between the normally-closed condition and an open condition. A mail slot is formed in the security door. It is adapted in size and shape to permit mail items to be deposited in the main housing without moving the security door between the normally closed condition and the open condition. This allows the mail carrier to deliver mail to the mailbox, without requiring that the mail carrier have possession of the key or combination for a combination lock.

The above as well as additional objectives, features, and advantages will become apparent in the following description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

Figure 1:
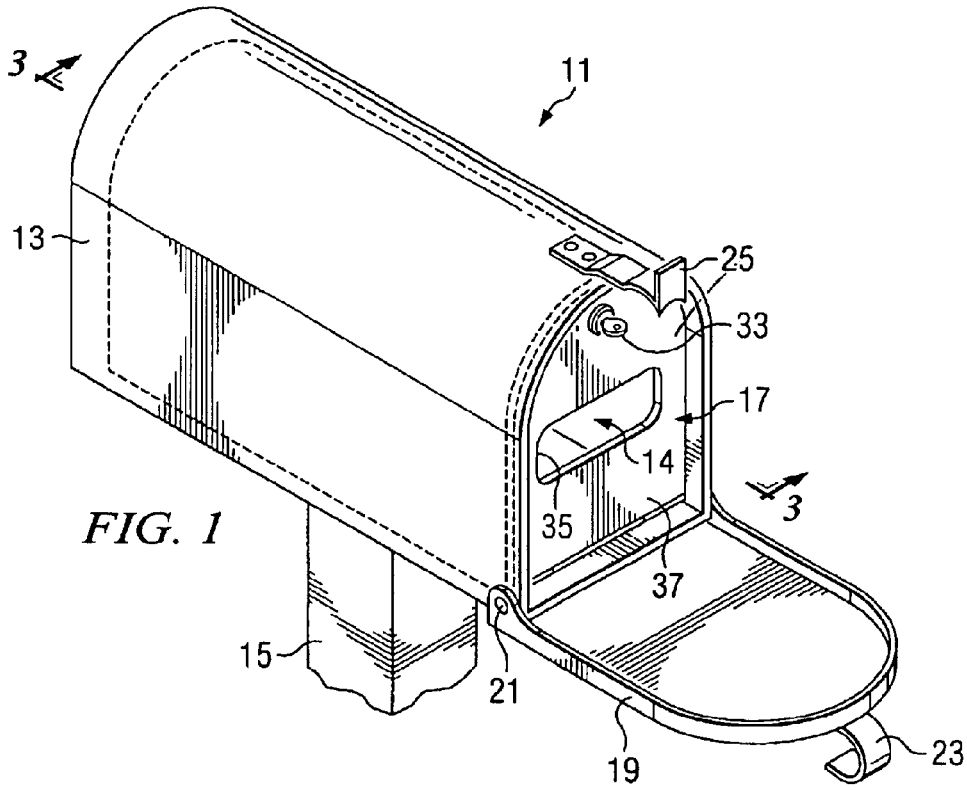
FIG. 1 is a pictorial representation of the improved mailbox in accordance with one embodiment of the present invention.

FIG. 1 is a perspective view of an improved mailbox 11 in accordance with one embodiment of the present invention. As is shown, the improved mailbox 11 includes a main housing 13. This is essentially a conventional mailbox which includes an elongated and domed housing which surrounds a central cavity 14 which is utilized to receive and house incoming and outgoing mail items. The improved mailbox 11 is secured to post 15 in a conventional fashion so that it stands at a height which conforms with postal requirements. The improved mailbox 11 includes a main door 19 which is coupled at hinge 21 to main housing 13. Main door 19 is adapted to move freely between an open condition and a closed condition to allow for access to central cavity 14 by postal carriers, but to maintain the mail items in a secure condition within central cavity 14 of main housing 13. The central cavity 14 serves to maintain mail items in a protected condition within the improved mailbox 11. Mail items which are not maintained in an enclosed housing are subject to damage or loss due to high winds, heat, high moisture, rain, snow, and sleet. The mailbox is designed to allow postal carriers to have quick and easy access to the central cavity 14 so they can operate efficiently, while maintaining the mail items in a condition which is safe from the external ambient weather conditions.

In accordance with the preferred implementation of the present invention, a security subassembly 17 is provided which is located within the main housing 13 of improved mailbox 11, and which is fixed and secured in position relative to main housing 13. As is shown in FIG. 1, in accordance with the preferred implementation of the present invention, the security subassembly 17 includes a lock mechanism 33 and a mail slot 35, both of which are accessible once main door 19 is in its lowered, and opened condition. In the configuration shown in FIG. 1, the main door 19 is an open condition, but the security door 37 is in a normally closed and secure condition. In this configuration, the mail carrier may deposit mail into the central cavity 14 of mailbox 11 through use of mail slot 35. Security door 37 remains closed and locked, thus deterring or preventing mail theft from mailbox 11. Once the carrier has deposited mail within central cavity 14 through mail slot 35, he or she may close main door 19 by swinging it upward and allowing door latch 23 to engage housing latch 25.

Figure 2:
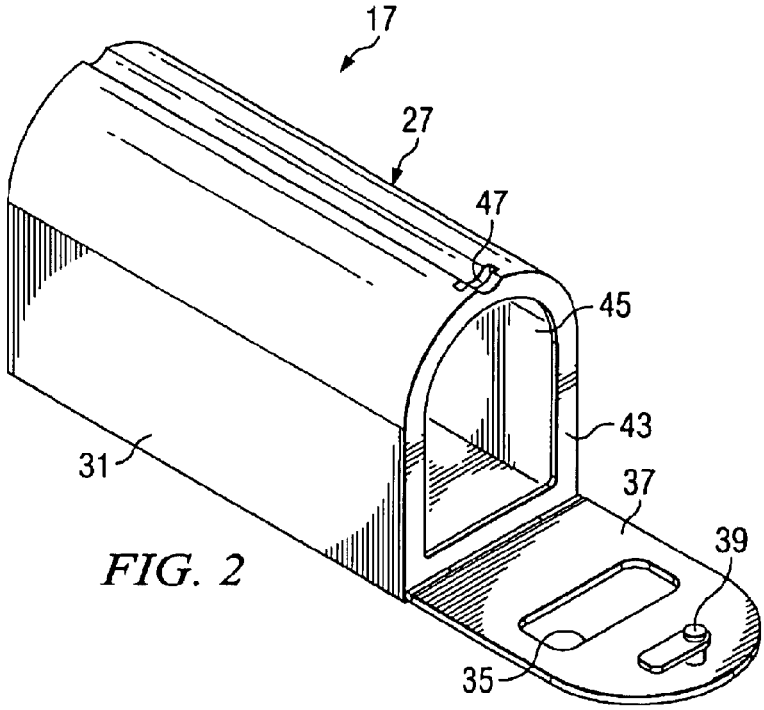
FIG. 2 depicts an improved security subassembly in accordance with the preferred embodiment of the present invention.

FIG. 2 depicts the preferred embodiment of the security subassembly of the present invention. As is shown, an elongated sleeve 27 is provided. The sleeve may be formed of metal or plastic. It is adapted in size and shape to reside within the main housing 13 of improved mailbox 11. As is shown, elongated sleeve 27 includes a domed (generally cylindrical) upper portion 29 and a generally rectangular lower portion 31. An elongated slight groove is provided at the upper portion of domed upper portion 29. This groove accommodates the screws and nuts which secure housing latch 25. This allows a user to retrofit a preexisting mailbox with a security system without requiring the removal and/or replacement of the screws and nuts which secure housing latch 25 to main housing 13. In the view of FIG. 2, security door 37 is depicted in an open condition. As is shown, it is coupled to elongated sleeve 27 at hinge 41. Several alternative "hinges" may be provided. In one approach, a rod-type hinge may be provided. Alternatively, plastic or metal pins may be provided. In another approach, the hinge is integrally-formed (from the plastic material). In the preferred embodiment, front panel 43 is provided at the front portion of elongated sleeve 27. Front panel 43 is adapted to abut security door 37 when it is in its normally closed condition. Front panel 43 includes preferably a mail opening 45 which is generally centrally located and adapted to be in alignment with mail slot 35 of security door 37. Additionally, front panel 43 includes tab opening 47 which is adapted to receive a portion of the lock mechanism 33. In the preferred embodiment, the tab 39 of lock mechanism 33 is adapted to extend into elongated sleeve 27 through tab opening 47 which is formed in front panel 43.

Figure 3:
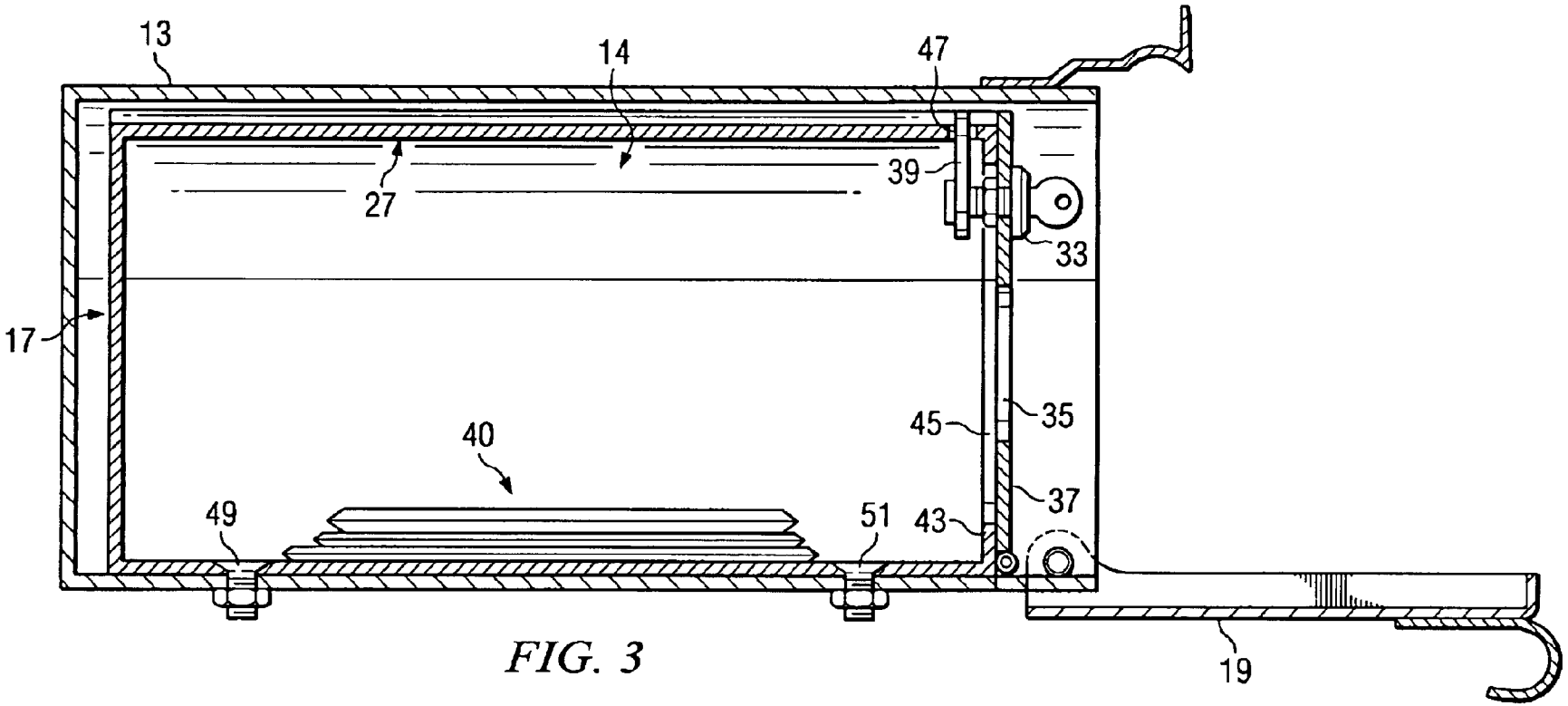
FIG. 3 is a longitudinal section view of the improved mailbox of FIG. 1 taken along Section line III—III. This embodiment utilizes fasteners to secure the security subassembly in position within the improved mailbox.
Figure 4:
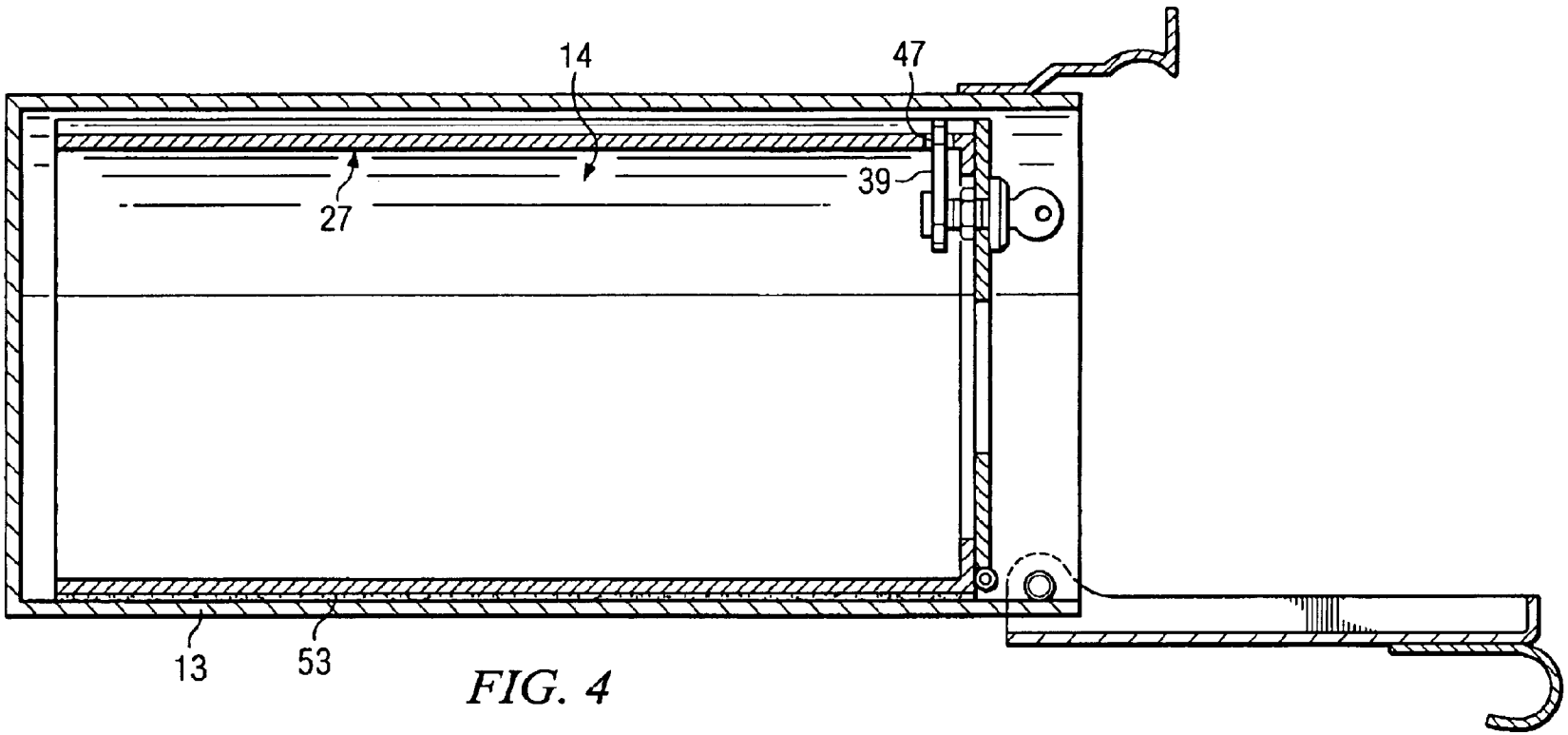
FIG. 4 is a longitudinal section view of the improved mailbox of FIG. 1 as seen along Section line III—III. This is an alternative embodiment which utilizes an adhesive to secure the security subassembly in position within the mailbox.

Security subassembly 17 may be secured into position within main housing 13 in a variety of alternative ways. Two alternative fastening systems are depicted in FIGS. 3 and 4. Both FIGS. 3 and 4 are longitudinal section views of FIG. 1 taken along Section line III—III. FIG. 3 represents the preferred embodiment, while FIG. 4 represents an alternative embodiment.

As is shown in FIG. 3, security subassembly 17 is located within central cavity 14 of main housing 13. Security subassembly 17 is adapted in size and shape to be maintained entirely within central cavity 14 of main housing 13. As is shown in FIG. 13, mail items 40 are maintained within security subassembly 17 until an authorized user utilizes a key to open the security door 37 and remove mail items 40 from central cavity 14 of main housing 13. Threaded fasteners 49, 51 are utilized to secure security subassembly 17 into position relative to main housing 13.

Also, as is shown in the view of FIG. 3, security door 37 is in abutment with front panel 43. In this condition, mail slot 35 is aligned with mail opening 45, allowing the postal carrier to deposit mail into central cavity 14 of main housing 13. Additionally, locking tab 39 extends through tab opening 47 of front panel 43. Preferably, the tab 47 extends into an upper tab cavity 46.

FIG. 3 depicts the security subassembly 17 in a normally-closed and locked condition with tab 39 engaging front panel 43 and preventing it from being opened. This provides some measure of security for the mail items 40 maintained within central cavity 14. An authorized user may utilize the key to unlock lock mechanism 33. Lock mechanism 33 will allow the appropriate key to move locking tab 39 ninety degrees allowing locking tab 39 to pass through tab opening 47. In the preferred embodiment, a key is utilized. In alternative embodiments, a combination lock may be utilized to secure security door 37 in place relative to elongated sleeve 27.

FIG. 4 is a longitudinal section view of the improved mailbox 11 of FIG. 1 taken along Section line III—III. It represents an alternative embodiment in which an adhesive 53 is utilized to secure elongated sleeve 27 into a fixed position relative to main housing 13.

As is shown in FIGS. 3 and 4, lock tab 39, will rotate between two positions which are ninety degrees (90%) apart. In an unlocked condition, tab 39 is aligned (parallel) with the bottom of the main housing 13. In a locked condition, lock tab 39 is orthogonal with the bottom of main housing 13. In this position, lock tab 39 extends into upper tab cavity 46 which is formed in the domed upper portion 29. This allows force to be transferred from security door 37 to elongated sleeve 27.

This is an advantageous force transference relationship since the security door 37 is only connected to elongated sleeve 27 at hinge 43. As discussed above, the hinge may comprise metal or plastic rods or pins which are located in a hinge-like structure (as is shown in FIGS. 3 and 4). Having lock tab 37 engage the main housing 13 at tab cavity 46 allows for a more secure connection between the security door 37 and elongated sleeve 27.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

What is claimed is:

1. An improved mailbox, comprising:

(a) a main housing having a central cavity for receiving and storing mail items;

(b) a main door, secured to said main housing for enclosing said main housing and thus protecting mail items maintained within said main housing from ambient conditions;

(c) a hinge coupling said main housing to said main door, allowing said main door to move freely between an open condition and a closed condition;

(d) a security subassembly, located at least in part within said main housing, and secured in a fixed position therein;

(e) a security door coupled to said security subassembly;

(f) a lock mechanism operatively associated with said security door and adapted to secure said security door in a normally closed condition, and to permit an authorized user to remove mail items from said main housing by moving said security door between said normally closed condition and an open condition;

(g) a mail slot formed in said security door and adapted in size and shape to permit mail items to be deposited in said main housing without moving said security door between said normally closed condition and said open condition;

(h) wherein said security subassembly includes an elongated sleeve which is adapted in size and shape to conform to the central cavity of said main housing;

(i) wherein said central cavity comprises a generally rectangular lower portion and a generally cylindrical upper portion; and (j) wherein said security subassembly is also comprised of generally rectangular portion and a generally cylindrical upper portion.

2. An improved mailbox, comprising:

(a) a main housing having a central cavity for receiving and storing mail items;

(b) a main door, secured to said main housing for enclosing said main housing and thus protecting mail items maintained within said main housing from ambient conditions;

(c) a hinge coupling said main housing to said main door, allowing said main door to move freely between an open condition and a closed condition;

(d) a security subassembly, located at least in part within said main housing, and secured in a fixed position therein;

(e) a security door coupled to said security subassembly;

(f) a lock mechanism operatively associated with said security door and adapted to secure said security door in a normally closed condition, and to permit an authorized user to remove mail items from said main housing by moving said security door between said normally closed condition and an open condition;

(g) a mail slot formed in said security door and adapted in size and shape to permit mail items to be deposited in said main housing without moving said security door between said normally closed condition and said open condition;

(h) an elongated sleeve which is adapted in size and shape to reside within said central cavity;

(i) a front panel, coupled to said elongated sleeve, and adapted in size to at least partially-occlude access to said central cavity, having a generally centrally located opening which is covered by said security door when said security door is in said normally closed condition, and which is utilized to remove said mail items from said main housing; and (j) wherein said front panel further includes a lock opening for permitting at least a portion of said lock mechanism to extend through said from panel.

* * * * *